United States Patent [19]

Kleinnibbelink

[11] Patent Number: 4,846,463

[45] Date of Patent: Jul. 11, 1989

[54] ALPINE SKIING TRAINING DEVICE

[76] Inventor: Frits Kleinnibbelink, Spreeuwenhof 69, 7051 XJ Varsseveld, Netherlands

[21] Appl. No.: 151,586

[22] Filed: Feb. 2, 1988

[30] Foreign Application Priority Data

Nov. 6, 1987 [NL] Netherlands ..... 8702665

[51] Int. Cl.[4] ..... A63B 69/18

[52] U.S. Cl. ..... 272/97; 434/253

[58] Field of Search ..... 272/97, 132, 96, 93, 272/70, 146, 94, 111, 109; 434/253

[56] References Cited

U.S. PATENT DOCUMENTS 4,629,181 12/1986 Krive ..... 272/97

FOREIGN PATENT DOCUMENTS

| | | | |
|---|---|---|---|
| 2333097 | 1/1975 | Fed. Rep. of Germany | 272/97 |
| 2581551 | 11/1986 | France | 272/97 |
| 481658 | 1/1970 | Switzerland | 272/97 |
| 1175511 | 8/1985 | U.S.S.R. | 272/97 |

*Primary Examiner*—S. R. Crow

*Attorney, Agent, or Firm*—John P. Snyder

[57] ABSTRACT

A training device for skiers includes an inverted V-shaped support defining an apex. One leg is rotatable about an upwardly inclined axis along a first angle and the other leg extends at a different angle from the apex. The free end of the other leg supports a platform for supporting the skier's feet. The other leg together with the platform swing in pendulum fashion about the apex and seek an equilibrium position under the action of gravity when the skier is not on the platform.

16 Claims, 2 Drawing Sheets

ALPINE SKIING TRAINING DEVICE

BACKGROUND OF THE INVENTION

The invention relates to a device for simulating the movements and forces occurring in connection with alpine skiing. Such a device can be used for training at home in preparation for a ski vacation. Prior art devices of this type include a carrying member that can roll or shift over a rail and which is urged into a stable centered position by means of two tension springs positioned at both sides thereof.

Devices of this type are designed to accurately simulate the movements and forces occurring in alpine skiing whereby a device may be employed for muscle training and also for educational purposes.

SUMMARY OF THE INVENTION

The present invention includes a frame which is placed on a floor. Bearing means is supported by the frame and rotatably supports a first shaft part at a first angle relative to the frame. A second support shaft part is connected with the first support shaft part at a second angle relative to the frame, and a support is provided at the free end of the second support shaft part. This support rotatably carries a carrying member which supports the feet of a person using the apparatus. The carrying member is a plate having an upper surface inclined downward in the direction of the bearing means. The rotation axis of the carrying member is disposed at a third angle with respect to the second support shaft part. When the components are in a rest position solely under the influence of gravity, the rotation axis is disposed in a substantially vertical plane.

An embodiment for use by less skilled users is characterized by stop means for determining the extreme positions between which the carrying member is rotatable. The stop means preferably comprises two stop pins provided on the carrying member, each of the stop pins having a resilient layer or sleeve thereon to cooperate with the second support shaft part and provide smooth, non-abrupt operation.

Depending upon the proficiency of the user and the type of training program involved, braking means may be provided for reducing the speed of rotation of the carrying member. This braking means may be adjustable if desired.

In order to provide adaptability of the device for variations in height of different users of the apparatus, the longitudinal position of the support and carrying member relative to the second support shaft part may be adjustable. The second support shaft may comprises two telescopically cooperating parts which can be secured against rotation and longitudinal movement relative to one another.

During an alpine skiing run, ski poles are used. In order to provide a comparable support for the purpose of control in the invention device, support means are supported by the frame and can be gripped by a user during use of the device. This support means can be two vertical sticks, tubes or bars which can be secured to the frame or which can be engineered as a unitary brace.

DETAILED DESCRIPTION OF THE INVENTION

Figure 1:
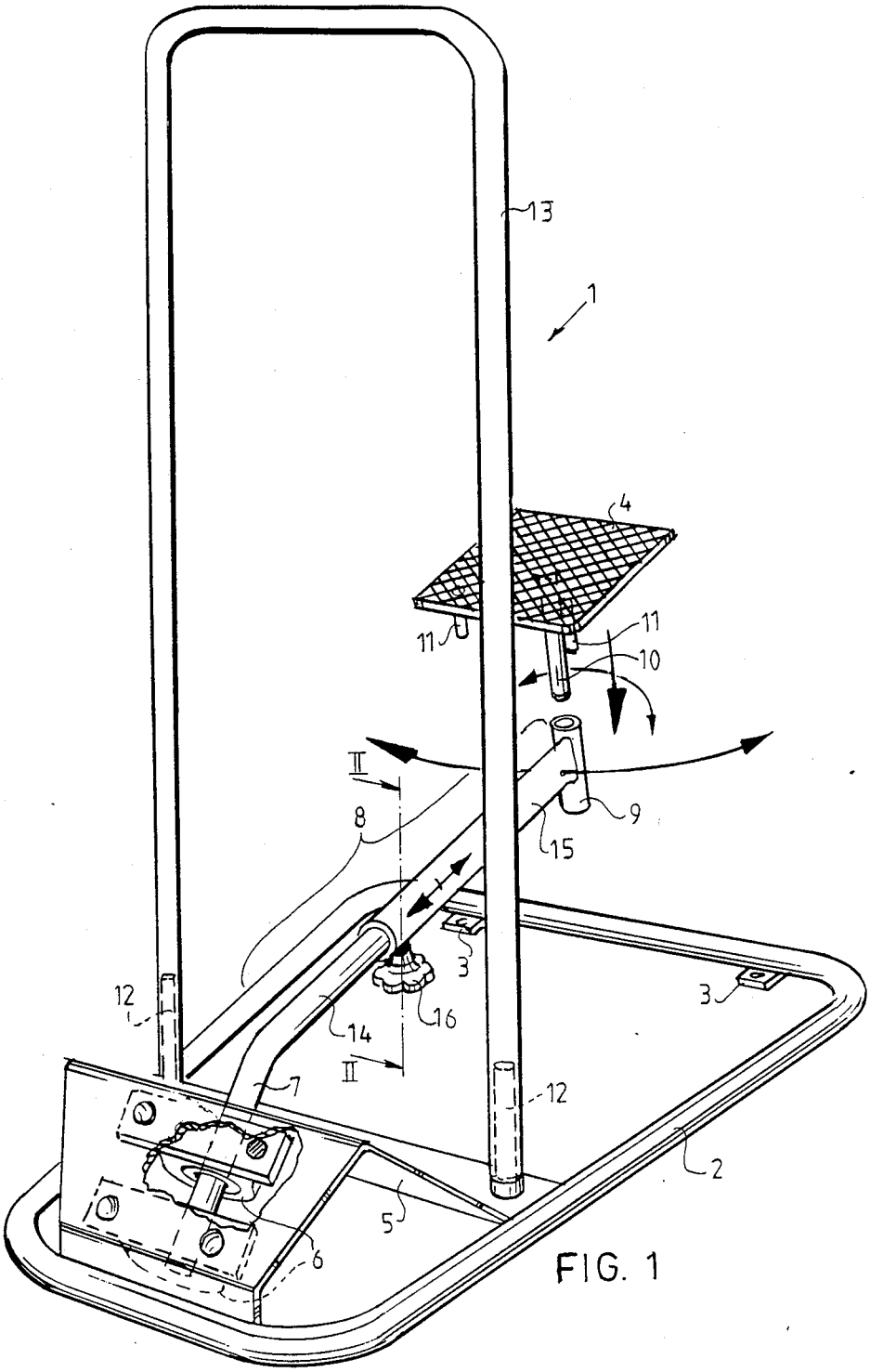
FIG. 1 is a perspective view, partially broken away, of an embodiment of the invention.

FIG. 1 shows a device 1 for simulating the movements and forces occurring in connection with alpine skiing. This device comprises a frame 2 to be placed on the floor. The frame 2 may be replaced by a plate, or it can be coupled with a plate by means of lugs 3 having screw holes formed therethrough. Such a plate can have a larger width and contribute to the stability of the device.

The device also comprises a carrying member 4 in the form of a plate on which a user places his feet. The carrying member is movable to and fro between two extreme positions in a path determined by guiding means described hereinafter, the carrying member being coupled with the frame 2 by means of the guiding means.

A frame plate 5 is fixed to the frame and supports two rotation bearings 6 at a first angle relative to the frame. In a simpler embodiment, the bearing means may comprise a sleeve-bearing having a nylon lining as the bearing element. Bearings 6 rotatably carry a first support shaft part 7 which supports a second support shaft part 8 at a second angle relative to the frame. The second support shaft part carries at its free end a nylon bearing sleeve 9 cooperating with a bearing spindle 10 coupled with the plate 4. The plate carries at its lower side two stop pins 11 each provided with a resilient envelope or sleeve. The rotation axis of plate 4 in the rest position is determined by gravity and lies in a substantially vertical plane.

Frame 2 further carries two support pins 12 on which a support brace 13 can be placed. Support brace 13 includes a pair of vertically extending tubular portions which are adapted to be gripped by the hands of a user.

Figure 2:
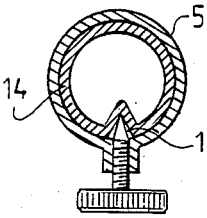
FIG. 2 is a cross-section along line II—II of FIG. 1.

The second support shaft part 8 consists of a first part 14 connected to the first support shaft part 7 and a second part 15 telescopically shiftable over said first part 14. FIG. 2 shows in cross-section the construction in more detail. A securing screw 16 serves to secure second part 15 against longitudinal displacement and rotation relative to first part 14. In order to prevent rotation, part 14 is provided with a groove 14 with which screw 16 cooperates.

Figure 3:
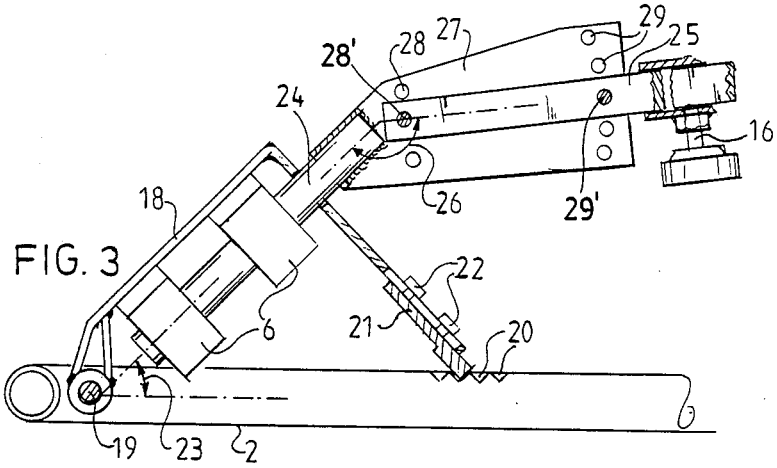
FIG. 3 is a detail of an alternative embodiment.

FIG. 3 shows an alternative embodiment in which a frame plate 18 is connected with frame 2 by means of a hinge 19. In order to adjust the angle of the frame plate, frame 2 includes stop ribs 20 adapted to cooperate with the adjustable end part 21 of the frame plate. The end part 21 can be fixed in different positions by means of screws 22. Accordingly, the first angle, indicated in FIG. 3 by numeral 23 can be adjusted.

In the embodiment shown in FIG. 3, the second angle 26 between the first support shaft part 24 and the second support shaft part 25 is adjustable. A plate 27 having perforations 28, 29 is present at the free end of the first support shaft part 24. Screws 28' and 29' cooperate with these perforations and the second support shaft part 25 to fix part 25 to plate 27 in different positions.

Figure 4:
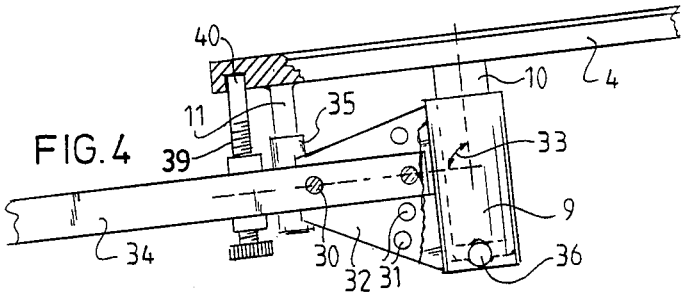
FIG. 4 is a detail of a further embodiment.

FIG. 4 shows a modified construction. In this case, the second support shaft part 34 carries the bearing sleeve 9 by means of a plate 32 provided with perforations 30 and 31. With the construction shown in FIG. 4, the angle between the axes of the second support shaft part 34 and the bearing sleeve 9 as well as bearing spindle 10 can be adjusted into a plurality of discrete positions.

As seen in FIG. 4, each of pins 11 is provided with a resilient coating layer 35 therearound. In a very practical and simple embodiment, this layer consists of a part of a rubber hose.

FIG. 4 also shows a bearing ball 36 serving as a bearing for spindle 10 in bearing sleeve 9. In this manner, very low rotation friction is ensured. Should, however, some friction be desired, this ball 36 can be left out and the bearing may comprise a friction bearing, the friction of which can be increased, if necessary, by providing a braking strip which may or may not be adjustable. A similar construction can be added in place of the rotation bearings 6 previously described.

A locking screw 39 can be turned into a blind hole 40 provided in plate 4. In this manner, the plate can be coupled in a fixed position to the second support shaft part 34.

Figure 5:
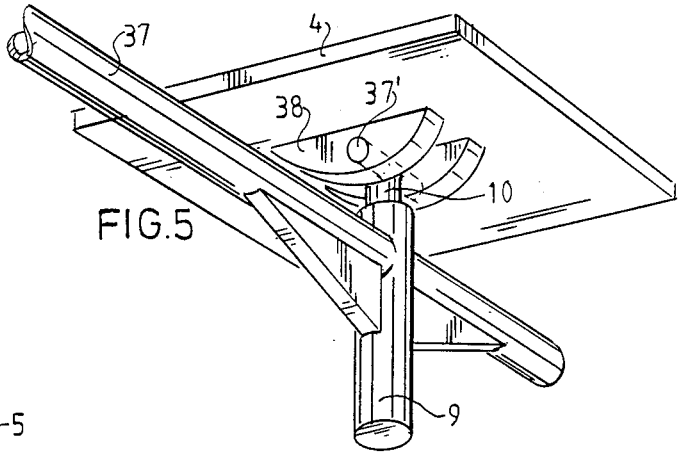
FIG. 5 is a detail of another embodiment.

FIG. 5 shows a second support shaft part 37 carrying a bearing sleeve 9 fixedly connected thereto. The bottom of the carrying member 4 is provided with ears 38 journalling the pivot shaft 37' to which the spindle 10 is attached and is pivotally received in the bearing sleeve 9. This construction introduces an additional degree of freedom, which however will mainly be reserved for the more experienced skier. In this simple embodiment, the second support shaft part 37 is the stop limiting the two extreme positions of wobbling movement of plate 4.

It should be noted that stop pins 11 may be adjustable by means of slot holes and bolts or the like. In the embodiment of FIG. 1, the carrying plate may be removed from the bearing sleeve and the pins positioned rearwardly of the apparatus so that the stop pins 11 become inoperative.

The support structure 7, 14 in FIG. 1 and 24, 25 in FIG. 3 defines in each case an inverted V-shaped structure. Taking FIG. 1 as an example, parts 7 and 14 lie in a common plane and their juncture point or apex lies uppermost at rest with no user supported on the carrying plate 4. Because the apex acts as a pendulum point when the part 7 rotates about its axis, the remote end of the part 14 with its extension 15, 9, swings freely along a path of concave form centered at the apex as is indicated by the arrow A in FIG. 1. The equilibrium position (no skier on the plate 4) is with the juncture point uppermost and the axis of member 10 in a vertical plane, under the influence of gravity.

Similarly in FIG. 3, the shaft 24 is at an upwardly inclined angle defining the first acute angle 23 with respect to the supporting surface and the part 25 is inclined at another angle 26 with respect to the supporting surface. More importantly, these two parts define an inverted V shape in which, once again, the apex remains in fixed position (except for rotation of the part 24). Part 25 which carries plate 4 seeks an equilibrium position under the influence of gravity and no load on the plate which places the swivel axis of the plate in a vertical plane. When there is a load on the platform, part 25 acts as a pendulum and swings back and forth along a concave path centered at the apex.

In operation, a user places his feet on the carrying plate and grasps one of the vertical tubes of support brace 13 in each hand. The user then shifts his body laterally of the device in the same manner that he would in making turns in a skiing run. The device will provide motions and positions for the user that closely duplicate those encountered during parallel skiing. Accordingly, the apparatus enables a user to practice all the movements involved and the proper technique in making a normal ski run.

I claim:

1. A free-swiveling training device for skiers which comprises the combination of a base adapted to be disposed on a support surface, an elongate first support part carried by said base for free rotation about an upwardly inclined first axis defining a first acute angle with respect to the support surface and presenting a free end portion, a second elongate support part connected to the free end of the first support part and extending therefrom along a second axis defining a second acute angle with respect to the support surface and presenting a free end portion, the second support part being freely rotatable with the first support part about the first axis, a platform carried by the free end portion of the second support part and upon which a skier may place his feet in simulation of a skiing stance, the first acute angle being different from the second acute angle to dispose the first and second support parts in an inverted V-shaped relation and allow the second support part to swing freely to a centered position relative to the apex of the V-shape along a concave upwardly extending arcuate path under the influence of gravity and position the platform above the second support part when a skier is not disposed on the platform, and permitting the freely-rotatable first and second support parts and the platform to swing back and forth relative to the base along the concave arcuate path to simulate body lean during skiing when the skier shifts body weight on the platform.

2. A training device as defined in claim 1 including means for adjusting the acute angle of the first axis.

3. A training device as defined in claim 2 including means for adjusting the acute angle of the second axis.

4. A free-swiveling and unrestrained training device for skiers which comprises the combination of a base adapted to be disposed on a support surface, an elongate first support part carried by said base for free rotation about an upwardly inclined first axis defining a first acute angle with respect to the support surface and presenting a free end portion, a second elongate support part connected at an angle to the free end of the first support part and extending therefrom in a substantially common plane along a second axis defining a second acute angle with respect to the support surface and presenting a free end portion, the second support part being freely rotatable with the first support part, bearing means carried by the free end portion of the second support part and defining a pivot axis transverse to the second support part, a platform upon which a skier may place his feet in simulation of a skiing stance, the platform having a depending pivot post received in said bearing means to permit the platform to rotate freely about said pivot axis, the first acute angle being greater than the second acute angle to dispose the first and second support parts in an inverted V configuration to allow the second support part to swing along a concave upwardly extending arcuate path centered at the apex of the V configuration under the influence of gravity to a centered position with the pivot axis in a vertical plane when a skier is not disposed on the platform, and permitting the freely-rotatable second support part and the freely-rotatable platform to swing back and forth relative to the base along the concave arcuate path to simulate body lean during skiing when the skier shifts body weight on the platform.

5. A training device as defined in claim 4 including means for adjusting the acute angle of the first axis.

6. A training device as defined in claim 5 including means for adjusting the acute angle of the second axis.

7. A training device as defined in claim 4 including a transverse pivot pin connecting the pivot post to the platform to provide an additional degree of freedom of movement for the platform.

8. A training device as defined in claim 7 including depending stop pins on said platform for limiting rotation between the platform and the second support part.

9. A training device as defined in claim 8 including means for adjusting the acute angle of the first axis.

10. A training device as defined in claim 9 including means for adjusting the acute angle of the second axis.

11. A free-swiveling training device for skiers under training which comprises the combination of a base adapted to be disposed on a support surface, an elongate generally V-shaped member having one leg portion of the V-shaped member carried by the base and extending therefrom along an upwardly inclined first axis defining a first acute angle with respect to the support surface, the elongate angled member having a second leg portion substantially coplanar with the first leg portion and joined to said one leg portion and extending therefrom along a second axis defining a second acute angle with respect to the support surface with the V-shaped member disposed in a substantially vertical plane, pivot means for pivoting the one leg portion for free rotation about said first axis, a platform carried by a free end portion of the second leg portion and upon which a skier while training may place his feet in simulation of a skiing stance, the platform being disposed above the second leg portion when the leg portions define an inverted V shape in a substantially vertical plane, the inverted V shape allowing the second support part to swing freely about said first axis to a centered position along a concave upwardly extending arcuate path under the influence of gravity and position the platform above the second support part when a skier is not disposed on the platform, and permitting the freely-swinging second leg portion and the platform to swing back and forth relative to the base along the concave arcuate path to simulate body lean during skiing when the skier shifts body weight on the platform.

12. A device as defined in claim 11 including a depending pivot post on said platform and bearing means carried by the second leg portion for receiving the pivot post.

13. A device as defined in claim 12 including a transverse pivot pin connecting the pivot post to the platform.

14. A training device as defined in claim 11 including means for adjusting the acute angle of the first axis.

15. A training device as defined in claim 14 including means for adjusting the acute angle of the second axis.

16. A training device as defined in claim 13 including depending stop pins on said platform for limiting rotation between the platform and the second leg portion.

* * * * *